US011603687B2

(12) United States Patent
Giovannetti

(10) Patent No.: US 11,603,687 B2
(45) Date of Patent: Mar. 14, 2023

(54) MECHANISM FOR MOVING A DOWNWARD FOLDING WING

(71) Applicant: EFFEGI BREVETTI S.R.L., Segrate (IT)

(72) Inventor: Antonio Giovannetti, Segrate (IT)

(73) Assignee: EFFEGI BREVETTI S.R.L., Segrate (IT)

( * ) Notice: Subject to any disclaimer, the term of this patent is extended or adjusted under 35 U.S.C. 154(b) by 34 days.

(21) Appl. No.: 17/289,276

(22) PCT Filed: Oct. 24, 2019

(86) PCT No.: PCT/EP2019/079077
§ 371 (c)(1),
(2) Date: Apr. 28, 2021

(87) PCT Pub. No.: WO2020/089040
PCT Pub. Date: May 7, 2020

(65) Prior Publication Data

US 2021/0404230 A1 Dec. 30, 2021

(30) Foreign Application Priority Data

Oct. 30, 2018 (IT) ..... 102018000009883

(51) Int. Cl.

| | |
|---|---|
| ***E05F 1/08*** | (2006.01) |
| ***E05D 3/18*** | (2006.01) |
| ***E05F 1/10*** | (2006.01) |
| ***E05F 1/12*** | (2006.01) |

(Continued)

(52) U.S. Cl.
CPC ..... *E05D 3/18* (2013.01); *E05F 1/1058* (2013.01); *E05F 1/1261* (2013.01); *E05F 5/027* (2013.01);

(Continued)

(58) Field of Classification Search
CPC ..... E05F 1/1276; E05F 1/1246; E05F 1/1253; E05F 1/1261; E05F 1/1058; E05F 1/1075;

(Continued)

(56) References Cited

U.S. PATENT DOCUMENTS 7,478,891 B2 * 1/2009 Hollenstein ..... E05F 3/106 312/328
7,500,287 B2 * 3/2009 Brustle ..... E05F 1/1075 16/289

(Continued)

FOREIGN PATENT DOCUMENTS

DE 10 2014 113 967 3/2016
WO 2016/131770 8/2016

OTHER PUBLICATIONS

International Search Report for PCT/EP2019/079077 dated Jan. 2, 2020, 3 pages.

(Continued)

*Primary Examiner* — Chuck Y Mah
(74) *Attorney, Agent, or Firm* — Nixon & Vanderhye

(57) ABSTRACT

Mechanism for the movement of a wing of furniture with a downward folding opening, designed to be placed on one side of the furniture item, the mechanism being contained in a box consisting of two half-shells, and including a hinge including a plurality of levers, articulated one in relation to the other, to the box and to the wing for the movement of the latter, one of the levers being able to slide in a track formed in the box, another of the levers being able to rotate around a fulcrum point provided on the box and acting with one of its ends on the front side of a linear slider, the rear side of which acts on one end of a rocker lever, whose other end acts on.

20 Claims, 7 Drawing Sheets

(51) Int. Cl.
*E05F 5/02* (2006.01)
*E05F 5/10* (2006.01)

(52) U.S. Cl.
CPC ..... *E05F 5/10* (2013.01); *E05Y 2201/11* (2013.01); *E05Y 2201/256* (2013.01); *E05Y 2201/264* (2013.01); *E05Y 2201/416* (2013.01); *E05Y 2201/626* (2013.01); *E05Y 2800/205* (2013.01); *E05Y 2800/21* (2013.01); *E05Y 2800/22* (2013.01); *E05Y 2900/20* (2013.01)

(58) Field of Classification Search
CPC ..... E05F 1/14; E05F 3/20; E05F 5/027; E05F 5/10; E05D 3/06; E05D 3/12; E05D 3/16; E05D 3/18; E05D 5/0276; E05D 11/00; E05D 11/11; E05Y 2201/21; E05Y 2201/264; E05Y 2201/416; E05Y 2201/47; E05Y 2201/492; E05Y 2201/618; E05Y 2201/626; E05Y 2900/20; E05Y 2900/202; A47B 2220/0072; Y10T 16/5383; Y10T 16/547; Y10T 16/5476; Y10T 16/5357; Y10T 16/5358; Y10T 16/5363; Y10T 16/5367
See application file for complete search history.

(56) References Cited

U.S. PATENT DOCUMENTS

| | | | | |
|---|---|---|---|---|
| 8,256,064 | B2 * | 9/2012 | Blersch | E05F 1/1292 16/366 |
| 8,807,670 | B2 * | 8/2014 | Blum | E05F 1/1276 312/328 |
| 8,894,162 | B2 * | 11/2014 | Kashiwaguma | E05F 1/1058 312/319.2 |
| 9,464,473 | B2 * | 10/2016 | Baldreich | E05F 1/1058 |
| 2004/0239213 | A1 * | 12/2004 | Hirtsiefer | E05D 15/262 312/109 |
| 2012/0084944 | A1 * | 4/2012 | Hirtsiefer | E05F 1/1058 16/349 |
| 2013/0031746 | A1 * | 2/2013 | Hasegawa | E05D 15/46 16/50 |
| 2015/0240546 | A1 | 8/2015 | Oshima et al. | |
| 2017/0044812 | A1 * | 2/2017 | Schluge | E05F 1/1058 |

OTHER PUBLICATIONS

Written Opinion of the ISA for PCT/EP2019/079077 dated Jan. 2, 2020, 5 pages.

* cited by examiner

MECHANISM FOR MOVING A DOWNWARD FOLDING WING

CROSS-REFERENCE TO RELATED APPLICATIONS

This application is the U.S. national phase of International Application No. PCT/EP2019/079077 filed Oct. 24, 2019 which designated the U.S. and claims priority to IT 102018000009883 filed Oct. 30, 2018, the entire contents of each of which are hereby incorporated by reference.

BACKGROUND OF THE INVENTION

Field of the Invention

The subject of the present invention is a mechanism for moving a wing of a piece of furniture, in particular a wing with a downward folding opening.

Description of the Related Art

The mechanisms for operating wings with downward folding, to which the present invention specifically relates, comprise a lever mechanism for operating a spring assembly, which is loaded when the wing is opened and discharged when it is closed, exerting a thrust that assists in the phase of rising of the wing.

The mechanisms for the above purposes available on the market are not completely satisfactory, either because they do not allow a gradual movement of the wing in the opening and closing phase, or because they cause knocks at the end of the opening and/or closing strokes of the wing.

Moreover, most of the time, these known mechanisms are of a rather complex design, and therefore expensive.

A lifting system for leaves of furniture that oscillate about at least one horizontal axis comprises a supporting body which can be connected to a fixed portion of the piece of furniture, a system of articulated levers with a first lever and a second lever which connect the supporting body to a leaf of the piece of furniture, and elastic actuation means which are functionally connected to the system of articulated levers in order to generate a rotation torque for the system of levers; the lifting system further comprises means which cooperate with the elastic actuation means in order to increase the rotation torque at least along a portion of the oscillation in the direction for opening the leaf.

SUMMARY OF THE INVENTION

The object of the invention is to eliminate the disadvantages of the prior art described above.

In particular, one of the objects of the invention is to provide a mechanism for moving a wing with a downward folding opening that allows a gradual movement of the wing, both in opening and in closing, with minimum effort by the user.

Another object of the invention is to provide such a mechanism that prevents the wing from slamming at the end of the opening and closing strokes.

Another object of the invention is to provide such a mechanism that is simple and economical to manufacture.

These and other objects of the invention are achieved by the mechanism of movement of downward folding herein disclosed and claimed.

Substantially, the mechanism for moving a furniture wing with a downward folding opening, designed to be placed on one side of the furniture item, is contained in a box consisting of two half-shells, and comprises a hinge comprising a plurality of levers, articulated one in relation to the other, to the box and to the wing for the movement of the latter, one of said levers being able to slide in a track formed in the box, another of said levers being able to rotate around a point of fulcrum provided on the box and acting with one of its ends on the front side of a linear slider, whose rear side acts on one end of a rocker lever, whose other end acts on a second linear slider subjected to the action of springs, two dampers being mounted on said linear slider (30), one damper (50) damping the final part of the descent stroke of the wing (6) during opening, and one damper (60) damping the final part of the ascent stroke of the wing (6) during closure.

BRIEF DESCRIPTION OF THE DRAWINGS

Further features of the invention will be made clearer by the detailed description that follows, referred to one of its embodiments purely by way of a non-limiting example, illustrated in the accompanying drawings, in which.

DESCRIPTION OF THE PREFERRED EMBODIMENTS

Figure 1:
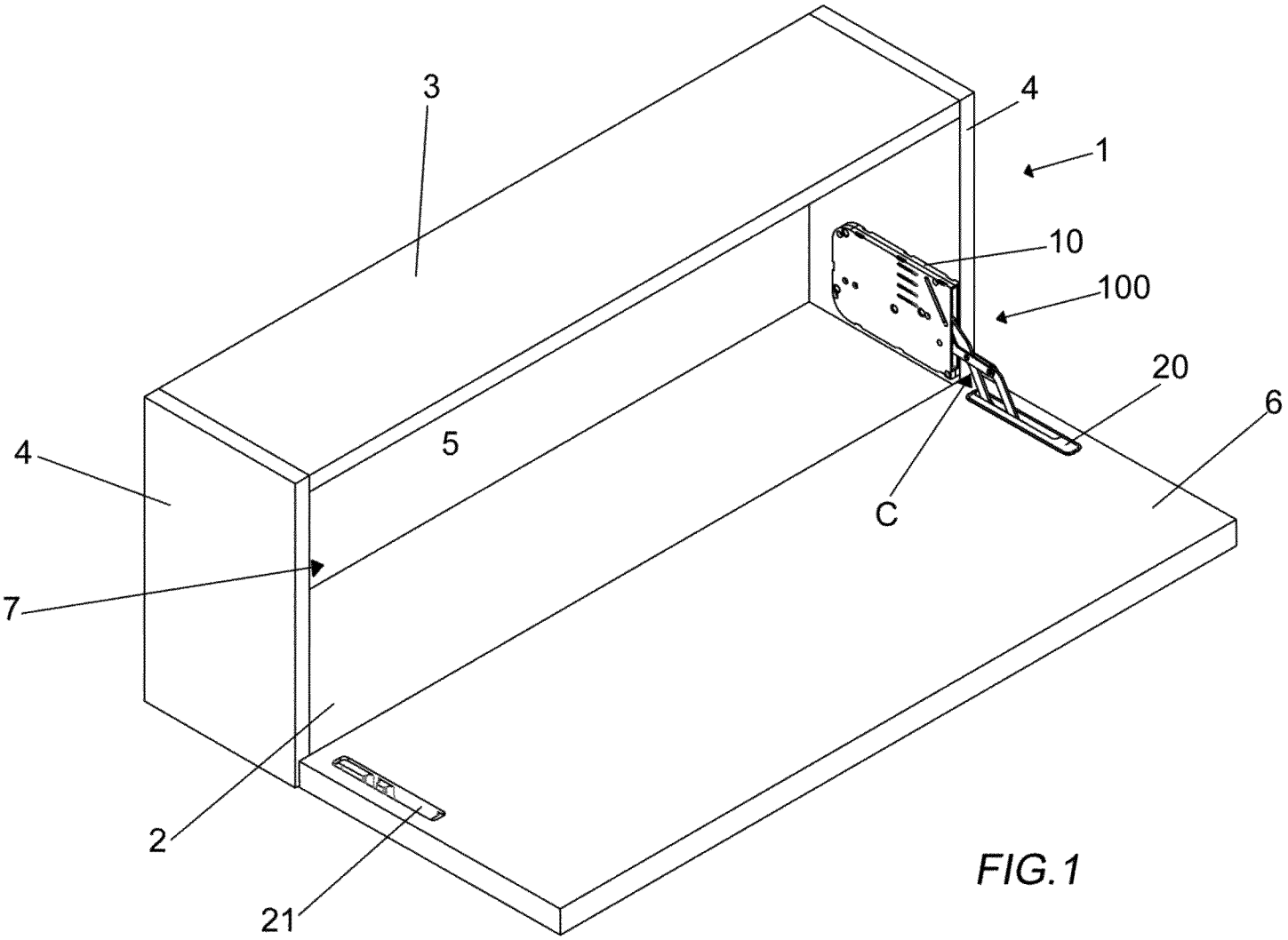
FIG. 1 is a schematic axonometric view of a piece of furniture with a wing with downward folding opening provided, on one of its sides, with a movement mechanism according to the invention.

FIG. 1 shows a furniture item, for example a kitchen furniture item, denoted overall by reference numeral 1, comprising a fixed frame consisting of a lower wall or shelf 2, a upper wall or shelf 3, two side walls or sides 4, a possible back wall 5, and a front wing 6, of the type with a downward folding opening which, in the raised position, closes off an internal compartment 7 of the furniture item.

The movement mechanism according to the invention is denoted overall by reference numeral 100, and is attached on a side 4 of the furniture item. In FIG. 1, mechanism 100 is attached internally to side 4 and, for aesthetic reasons, is covered by a cap or by a covering counter-shoulder. Mechanism 100 can in any case also be housed in the interior of side 4.

Figure 2:
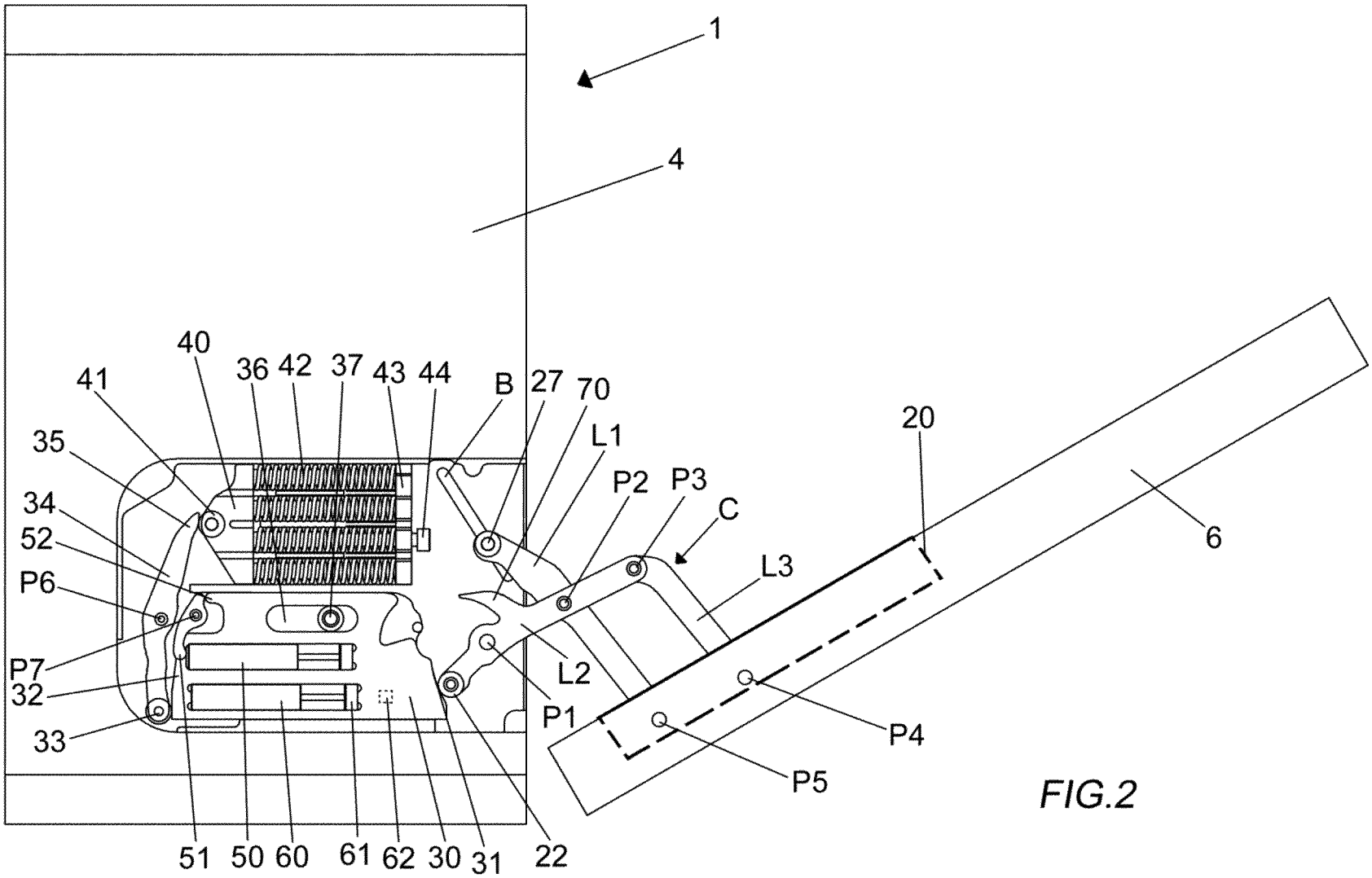
FIG. 2 is a view of the inner side of the furniture item of FIG. 1, with the lid of the mechanism containment box removed and with the wing in an intermediate position during opening or closing.
Figure 3:
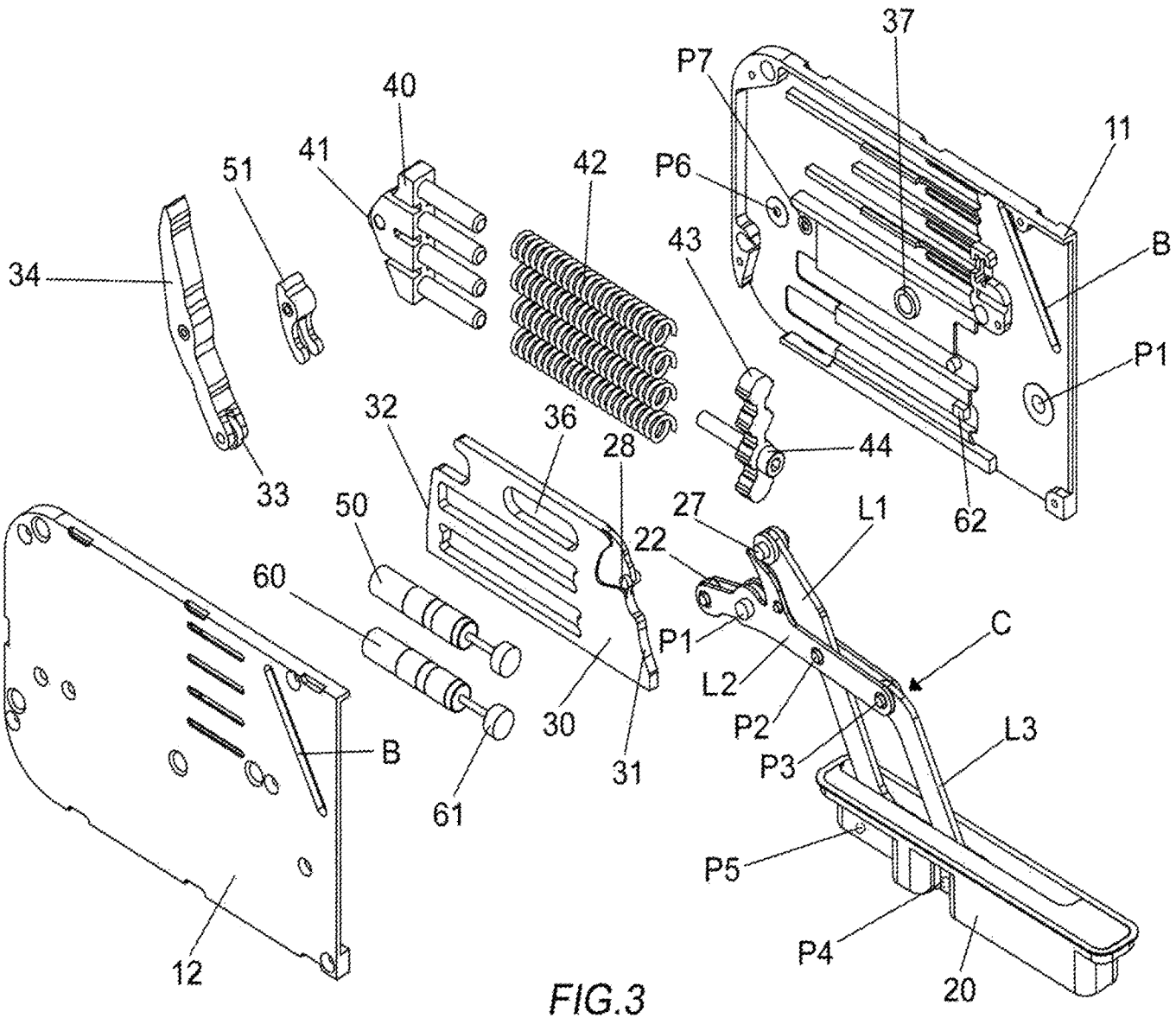
FIG. 3 is a blown-up view of the mechanism.
Figure 4:
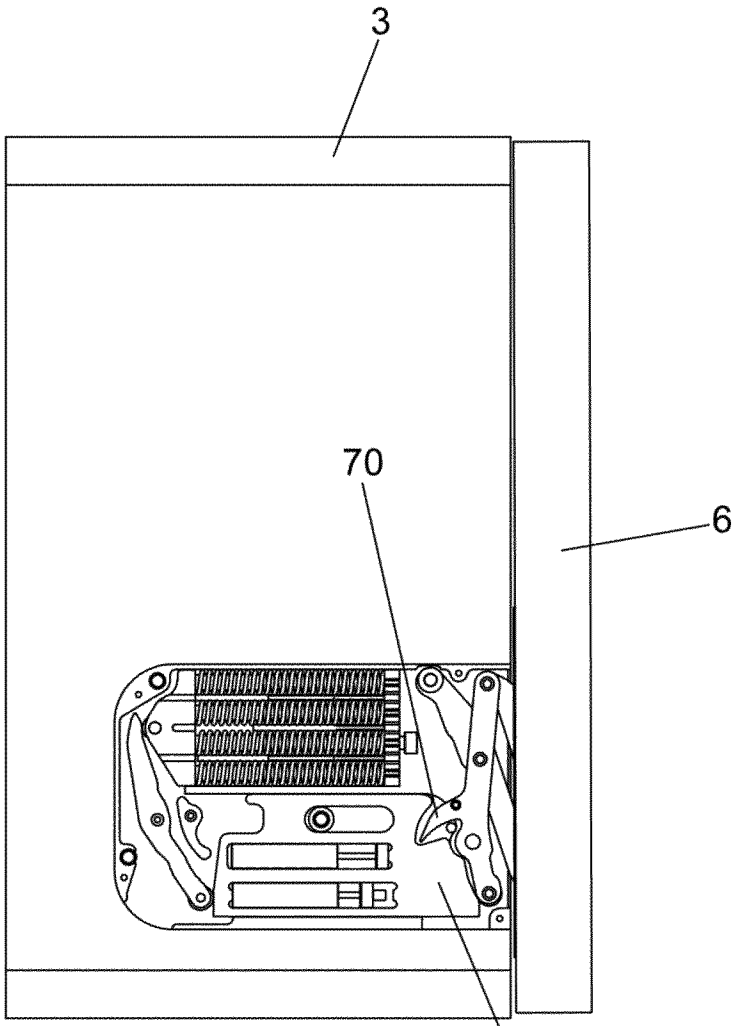
FIGS. 4 to 7 are views like that of FIG. 2, on a smaller scale, showing various positions of the wing in an opening or closing cycle.
Figure 5:
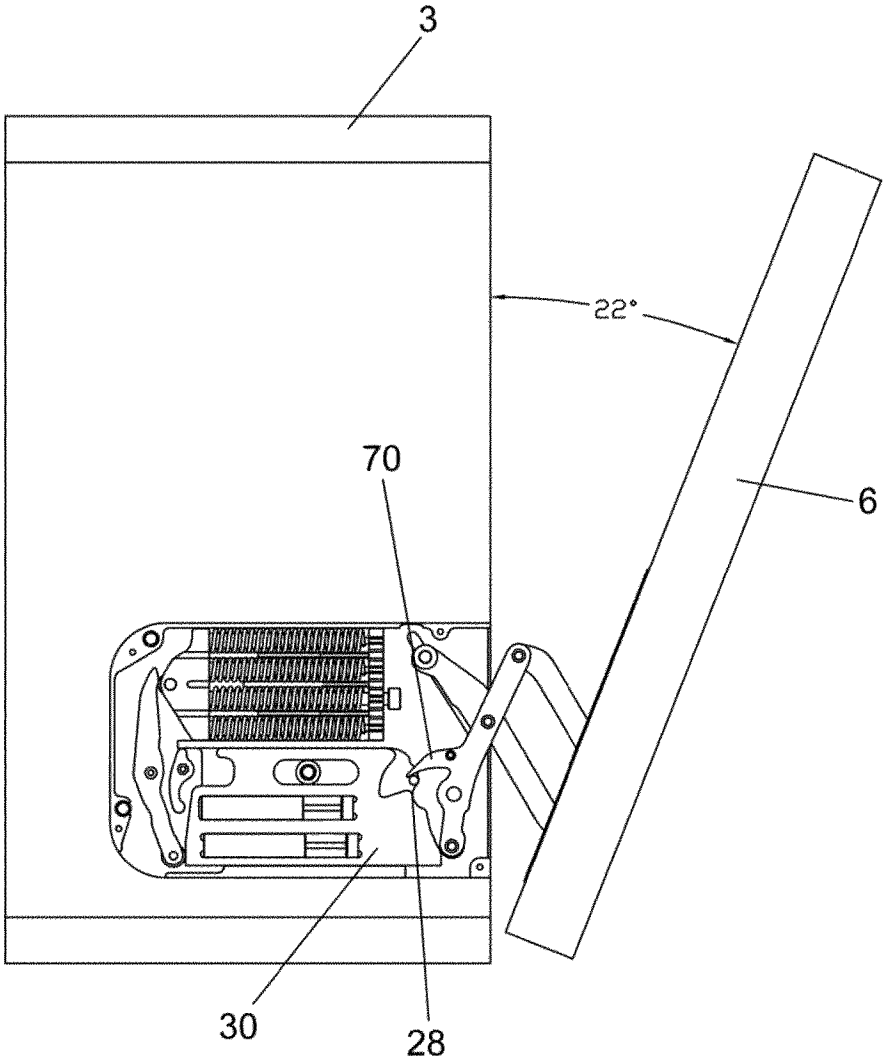
Figure 6:
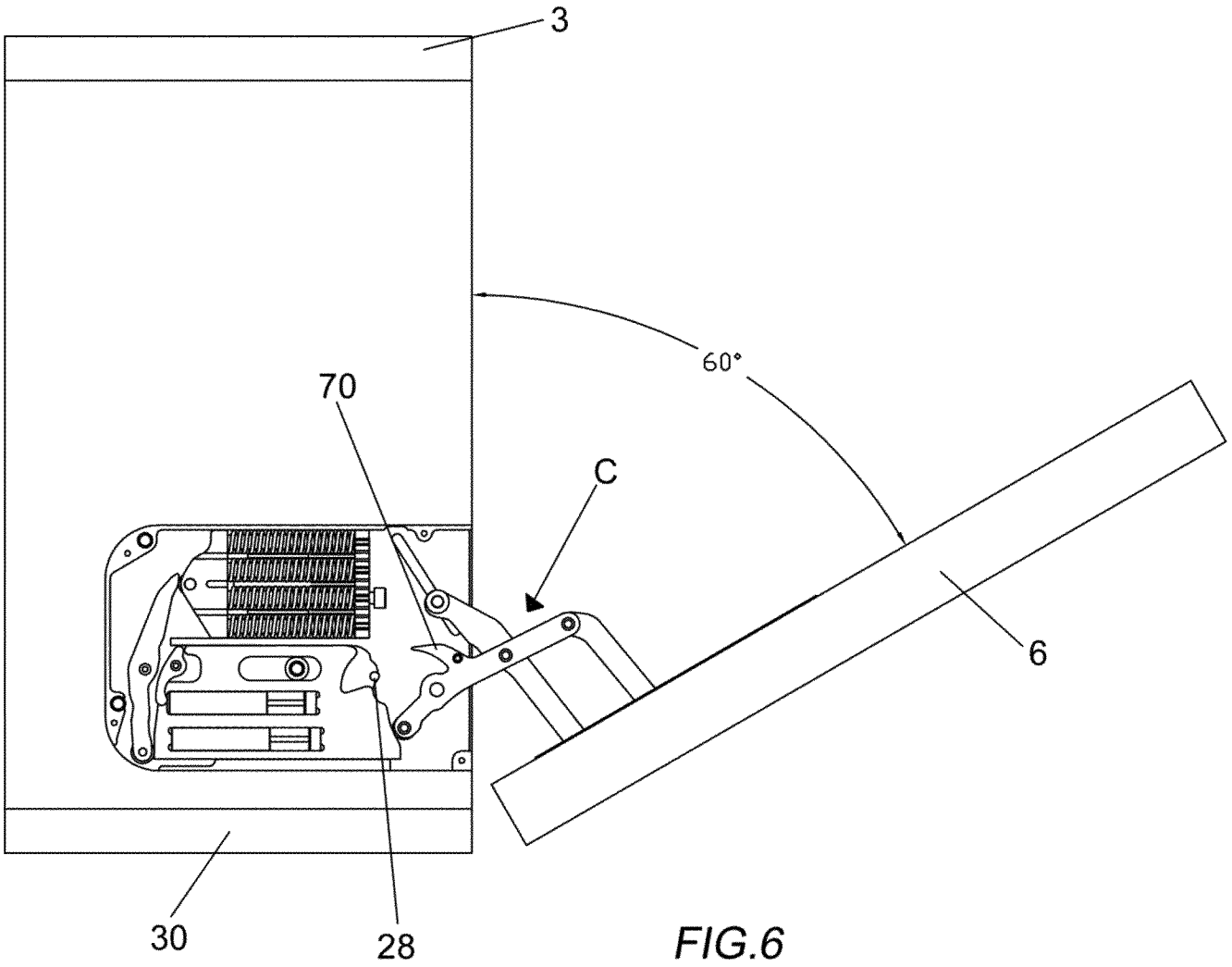
Figure 7:
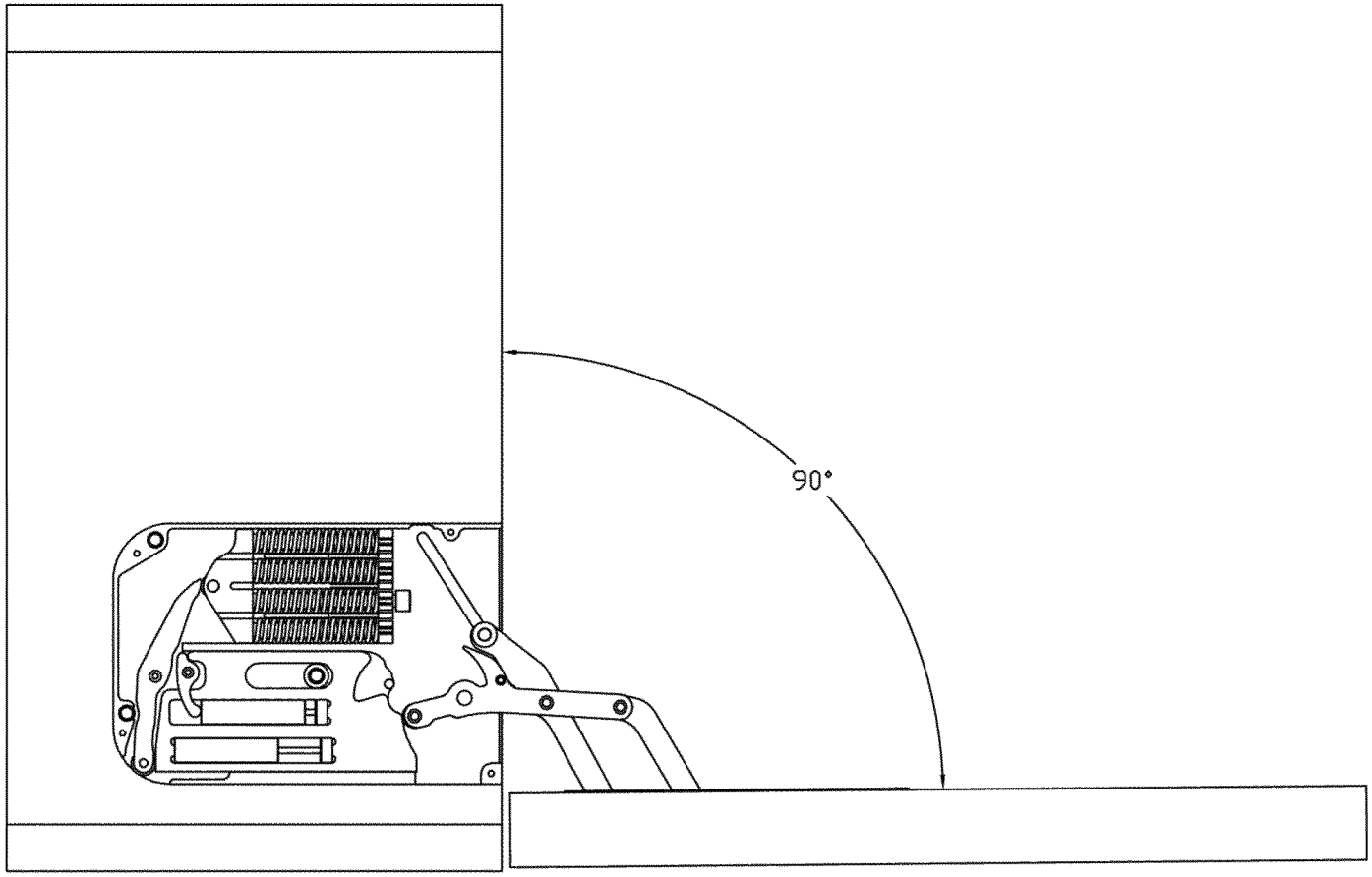

Referring now to FIGS. 2 and 3, the structure of mechanism 100 is illustrated, whose components are mounted in a box 10, consisting of two half-shells 11 and 12, which here below will be referred to, respectively, as base and cover, and impart the movement of the wing 6 by means of a hinge with five points P1, P2, P3, P4, P5 and an attachment 20 housed in a seat 21 formed inside the wing. In FIG. 1 this seat 21 is shown at both sides of the wing 6, so as to accommodate the attachment 20 of a mechanism 100 attached on the right or left side of the furniture item 1, or on both sides.

Hinge C consists of three levers L1, L2, L3.

Levers L1 and L2 are articulated one in relation to the other in the fulcrum point P2, placed in an intermediate zone. Lever L2 is articulated at one end in the fulcrum point P3 at one end of lever L3, the other end of which is articulated in fulcrum point P4 to attachment 20, which is then fixed to the wing. One end of the lever L1 is also articulated at the attachment 20 fixed to the wing 6 in the fulcrum point P5, while the other end of the lever L1 carries a pin 27 sliding in a track B formed in box 10.

Lever L2 is articulated in the fulcrum point P1 also restrained to box 10.

The end of the lever L2 opposite the fulcrum point P3 carries a roller 22 that acts on a cam profile 31 of a slider 30 housed in the box 10 between the half-shells 11 and 12.

The hinge C thus structured is forced, during the movement of the wing 6, to rotate around the fulcrum point P1 and to slide in the track B, formed in the two half-shells 11, 12 of box 10.

Track B is shown as the linear type in the accompanying drawings, but it can also have a curved profile. In fact, by varying the position of the fulcrum point P1 and the shape of track B, it is possible to obtain different rotations of the wing 6, for example on the basis of the thickness of the latter.

The functioning of the mechanism is now described, introducing on each occasion the essential elements that compose it.

Referring to FIGS. 4 to 7, during the descent of wing 6, the roller 22 of lever L2, acting on the front cam profile 31 of slider 30, linearly pushes the latter to the left, with reference to the drawings.

The rear part of slider 30, i.e. the part distal from hinge C, also has a cam profile 32, which acts on a roller 33 provided at one end of a rocker lever 34 hinged in a point P6 to box 10. The other end 35 of the rocker lever 34 acts on a slider 40 through a roller 41 carried by the latter.

The slider 40 moves linearly and is under the action of springs 42 that abut against a striker 43, whose position is adjustable by means of a screw 44 in order to vary the compression of the springs and therefore the force that they develop, in order to adapt to wings of different height and weight, within a certain operating range.

When the wing 6, under the action of its own weight, falls downwards, the springs 42, compressing themselves, contrast the fall thereof, reducing the speed of descent.

The final part of the fall of the wing 6 is also cushioned through the action of a damper 50, integral with the slider 30. The damper 50 is operated by a small lever 51, which is hinged to box 10 in one of its intermediate points P7. During the backward stroke, slider 30 hits one end of small lever 51 with one of its rear projections 52 which, rotating around the fulcrum point P7, goes to compress with its other end the damper 50, thus obtaining the cushioned effect. The damping force of the damper 50 can be varied by varying the lever arms of small lever 51.

During closure of the wing, the opposite effect is obtained.

When, in fact, the wing 6 is raised, the springs 42 that had previously been compressed exert a thrust force on the rocker lever 34, which transmits it to the wing through the slider 30, which moves to the right. This allows a reduction in the lifting force that has to be applied to the wing in order to make it close. When wing 6 reaches about 22° of complete closure (FIG. 5), the force of the springs 42 exceeds the weight force of the wing, causing it to close automatically.

During this closing phase, a second damper 60 intervenes, also carried integrally by the slider 30, so as to have a cushioned effect even during closure. In particular, when slider 30 slides forwards, to the right with reference to the drawings, it drags with it the damper 60, whose stem 61 impacts against a stop 62 provided on the half-shells 11 and 12 of box 10, thus compressing the damper 60.

The slider 30 is guided by a slot 36 provided therein, in which is inserted a pin 37 integral with the box 10.

The lever L2 has a beak protrusion 70 which, during closure of the wing (FIG. 5), goes to abut against a pin 28 provided on the slider 30. This means that in the case of violent closures of wing 6, the latter does not hit against the upper shelf 3 of the furniture item.

From what is disclosed the advantages of the mechanism for moving wings with downward folding according to the invention appear clear, which allows a gradual movement of the wing both during opening and closing and a damping of the same in the final phases of opening and closing.

Naturally the invention is not limited to the particular embodiment previously described and illustrated in the accompanying drawings, but numerous detailed changes may be made thereto within reach of the person skilled in the art, without thereby departing from the scope of the invention itself, defined by the appended claims.

The invention claimed is:

1. A mechanism (100) for moving a furniture wing with a downward folding opening, designed to be placed on a side (4) of a piece of furniture (1), said mechanism being contained in a box (10) with two half-shells (11, 12), said mechanism comprising:

a hinge (C) comprising a plurality of levers configured to articulate in relation to one another, to the box (10), and to the wing (6) for moving the wing, a first lever (L1) of said plurality of levers being configured to slide in a track (B) formed in the box (10), and a second lever (L2) of said plurality of levers being configured to rotate around a first fulcrum point (P1) provided on the box (10), a first end (22) of the second lever (L2) acting on a front side (31) of a first linear slider (30), a rear side (32) of the first linear slider (30) acting on a first end (33) of a rocker lever (34), and an opposing second end (35) of the rocker lever (34) acting on a second linear slider (40) subjected to an action of springs (42), first and second dampers being mounted on said first linear slider (30), the first damper (50) damping a final part of a descent stroke of the wing (6) during opening of the wing, and the second damper (60) damping a final part of an ascent stroke of the wing (6) during closure of the wing.

2. The mechanism according to claim 1, wherein said hinge (C) has three levers, the first and second levers (L1, L2) of the three levers configured to articulate one in relation to the other in an intermediate second fulcrum point (P2), a second end of the second lever (L2) opposite to said first end (22) of the second lever (L2) being articulated in a third fulcrum point (P3) at a first end of a third lever (L3), an opposing second end of the third lever (L3) being articulated in a fourth fulcrum point (P4) to an attachment (20) fixed to the wing (6), a first end of the first lever (L1) sliding with an end pin (27) in said track (B) formed in the box (10), and the first lever (L1) being articulated with an opposing second end of the first lever (L1) in a fifth fulcrum point (P5) to said attachment (20) fixed to the wing (6).

3. The mechanism according to claim 2, wherein said fourth and fifth fulcrum points (P4, P5) are provided in the attachment (20) fixed to the wing (6).

4. The mechanism according to claim 2, wherein said second lever (L2) carries a beak projection (70) which, during the closure of the wing (6), moves to abut against a pin (28) provided on the first slider (30), such that, in the case of a violent closing of the wing, the wing does not hit an upper shelf (3) of the piece of furniture.

5. The mechanism according to claim 2, wherein said front (31) and rear (32) sides of the first linear slider (30) have cam profiles.

6. The mechanism according to claim 5, wherein said springs (42) are compression springs which can be preloaded by means of a screw (44) acting on a mobile abutment (43).

7. The mechanism according to claim 2, wherein said springs (42) are compression springs which can be preloaded by means of a screw (44) acting on a mobile abutment (43).

8. The mechanism according to claim 2, wherein said track (B) formed on the box (10) is linear or curvilinear.

9. The mechanism according to claim 1, wherein said front (31) and rear (32) sides of the first linear slider (30) have cam profiles.

10. The mechanism according to claim 9, wherein said springs (42) are compression springs which can be preloaded by means of a screw (44) acting on a mobile abutment (43).

11. The mechanism according to claim 9, wherein said track (B) formed on the box (10) is linear or curvilinear.

12. The mechanism according to claim 2, wherein said fourth and fifth fulcrum points (P4, P5) are provided in the attachment (20) fixed to the wing (6).

13. The mechanism according to claim 1, wherein said springs (42) are compression springs which can be preloaded by means of a screw (44) acting on a mobile abutment (43).

14. The mechanism according to claim 13, wherein said damper (50) is actuated by a first end of a small lever (51) pivoted in a seventh point (P7) to said box (10), and a protrusion (52) of said first linear slider (30) acts upon a second end of the small lever (51), said first linear slider (30) moving rearwards during the opening of the wing.

15. The mechanism according to claim 14, wherein said second damper (60) is actuated by a stop (62) provided internally to the half-shells (11, 12) of the box (10), a stem (61) of the second damper (60) impacting against said stop (62) during a phase of advancing the first linear slider (30) during the closing of the wing (6).

16. The mechanism according to claim 14, wherein said track (B) formed on the box (10) is linear or curvilinear.

17. The mechanism according to claim 13, wherein said second damper (60) is actuated by a stop (62) provided internally to the half-shells (11, 12) of the box (10), a stem (61) of the second damper (60) impacting against said stop (62) during a phase of advancing the first linear slider (30) during the closing of the wing (6).

18. The mechanism according to claim 17, wherein said track (B) formed on the box (10) is linear or curvilinear.

19. The mechanism according to claim 13, wherein said track (B) formed on the box (10) is linear or curvilinear.

20. The mechanism according to claim 1, wherein said track (B) formed on the box (10) is linear or curvilinear.

* * * * *